US005613187A

United States Patent [19]

Stock et al.

[11] Patent Number: 5,613,187

[45] Date of Patent: Mar. 18, 1997

[54] ROTATIONALLY SYMMETRICAL ARTICLE WITH PROPERTIES VARYING OVER THE CROSS-SECTION

[75] Inventors: Dieter Stock, Regglisweiler, Germany; W. Gary Watson, Cheshire, Conn.

[73] Assignee: Wieland-Werke AG Metallwerke, Ulm, Germany

[21] Appl. No.: 510,010

[22] Filed: Aug. 1, 1995

Related U.S. Application Data

[63] Continuation of Ser. No. 139,220, Oct. 19, 1993, abandoned.

[30] Foreign Application Priority Data

Oct. 20, 1992 [DE] Germany ..... 42 35 303.3

[51] Int. Cl.[6] ..... B22F 5/00

[52] U.S. Cl. ..... 428/547; 428/551; 428/552

[58] Field of Search ..... 428/546, 547, 428/548, 551, 552, 555

[56] References Cited

U.S. PATENT DOCUMENTS

| | | | |
|---|---|---|---|
| 4,674,554 | 6/1987 | Feest | 164/46 |
| 4,681,772 | 7/1987 | Rairden | 427/34 |
| 4,820,358 | 4/1989 | Chang | 148/13 |
| 4,911,625 | 3/1990 | Begg et al. | 419/6 |
| 5,164,347 | 11/1992 | Kennedy et al. | 501/127 |
| 5,240,672 | 8/1993 | Yang | 419/47 |
| 5,253,697 | 10/1993 | LaJoye et al. | 164/97 |

FOREIGN PATENT DOCUMENTS

| | | |
|---|---|---|
| 0270265 | 6/1988 | European Pat. Off. . |
| 1379261 | 1/1975 | United Kingdom . |
| 1472939 | 5/1977 | United Kingdom . |
| WO92/04475 | 3/1992 | WIPO . |
| WO92/15721 | 9/1992 | WIPO . |

*Primary Examiner*—Charles T. Jordan
*Assistant Examiner*—Chrisman D. Carroll
*Attorney, Agent, or Firm*—Flynn, Thiel, Boutell & Tanis, P.C.

[57] ABSTRACT

A rotationally symmetrical preform (1) is made by atomizing molten metal by means of a gas jet in a nozzle and by deposition of the droplets on a suitable substrate, wherein at least two independent nozzles (2,3) are arranged so that their droplet streams (4,5) overlap and are directed onto a substrate (6) of circular cross-section, and wherein insoluble particles are injected either into the first or into the second droplet stream (4 or 5) or wherein different types of particles are injected into the first and the second droplet stream (4,5).

10 Claims, 2 Drawing Sheets

ROTATIONALLY SYMMETRICAL ARTICLE WITH PROPERTIES VARYING OVER THE CROSS-SECTION

This application is a continuation of U.S. Ser. No. 08/139,220, filed Oct. 19, 1993, now abandoned.

FIELD OF THE INVENTION

The invention relates to rotationally symmetrical articles mainly in copper or copper alloys, the properties of which vary over the cross-section.

BACKGROUND OF THE INVENTION

Preforms having a varying alloy composition and resulting in varying properties needed for the article are state of the art (e.g. German Published Application No. 4 105 420). The production may follow the method of spray deposition (e.g. British Patent Nos. 1 379 261 and 1 472 939) where the molten metal is atomized by a gas jet in a suitable nozzle and the droplets are collected to form a coherent deposit.

According to German Published Application No. 4 105 420, the initial preform is made from an alloy that contains no modifying additions by molten metal being sprayed onto a rotating hollow mandrel. The layers added later on have an alloy composition modified by the modifying additions that are added to the molten metal and sprayed together with it.

SUMMARY OF THE INVENTION

The purpose of the invention is to increase the variety of rotationally symmetrical preforms and the number of combinations of characteristics of the article.

According to the invention, the preform consists of a core and at least one surrounding outer layer and the modifying additions are particles that are insoluble in the metal matrix and have been introduced either into the core or into the outer layer.

An embodiment of the invention is a preform consisting of a core and at least one surrounding outer layer wherein the modifying additions are particles insoluble in the metal matrix and wherein different particles have been introduced into the core and into the outer layer.

A known method of spray deposition is the introduction of dispersoid particles into the droplet stream (see European Patent No. 0 198 606), but not for making a multilayer structure.

According to a particular embodiment of the invention, it is proposed to choose molybdenum, niobium, tungsten, lead or other metals as insoluble metallic particles.

According to another embodiment of the invention, the insoluble particles chosen are non-metallic particles of an oxide, a carbide, a boride, a nitride, etc.; in particular, particles of alumina ($Al_2O_3$), silicon carbide (SIC) or boron nitride (BN). The particles are preferably deposited at the grain boundaries.

For the preliminary stage of production of the rotationally symmetrical preform, the method preferably used is spray casting where the molten metal is atomized to droplets by a gas jet in a nozzle and the droplets are collected on a rotating substrate. According to the invention, at least two nozzles operating simultaneously, but independently, are arranged so that their respective streams of droplets overlap and are directed to a substrate of round cross-section with insoluble particles being injected either into the first or into the second stream of droplets or with different types of particles being injected simultaneously into the first and the second stream of droplets.

Preferably, at least one atomizer simultaneously injects into the first and second droplet stream particles that are insoluble and particles that are clearly soluble in the metal matrix (e.g. insoluble lead particles and soluble nickel particles into a stream of copper alloy droplets). The subsequent hot forming of the preform leads to alloy formation with the soluble particles leading to the desired modification of properties.

Some of the combinations possible according to this method are:

1. Conductive core (copper), outer layer with low coefficient of expansion (copper-niobium)
2. Ductile core (copper), high-strength outer layer (copper-alumina/copper-silicon carbide)
3. High-strength core (copper-alumina/copper silicon carbide), workable outer layer (copper-boron nitride)
4. High-strength core (copper-alumina/copper silicon carbide), high-conductivity outer layer (copper)
5. Workable core (copper alloy-boron nitride/copper alloy-lead/copper alloy-molybdenum sulphide) and a surrounding outer layer
6. Conductive core (copper alloy), corrosion and wear resistant outer layer (copper alloy-nickel, alumina/copper alloy-nickel, silicon carbide)
7. High-strength conductive core (copper alloy alumina/copper alloy-silicon carbide), outer layer with good sliding properties (copper alloy-graphite/copper alloy-lead/copper alloy-molybdenum sulphide).

BRIEF DESCRIPTION OF THE DRAWINGS

The invention will now be described by way of example with reference to the accompanying drawings in which.

DETAILED DESCRIPTION

Figure 1:
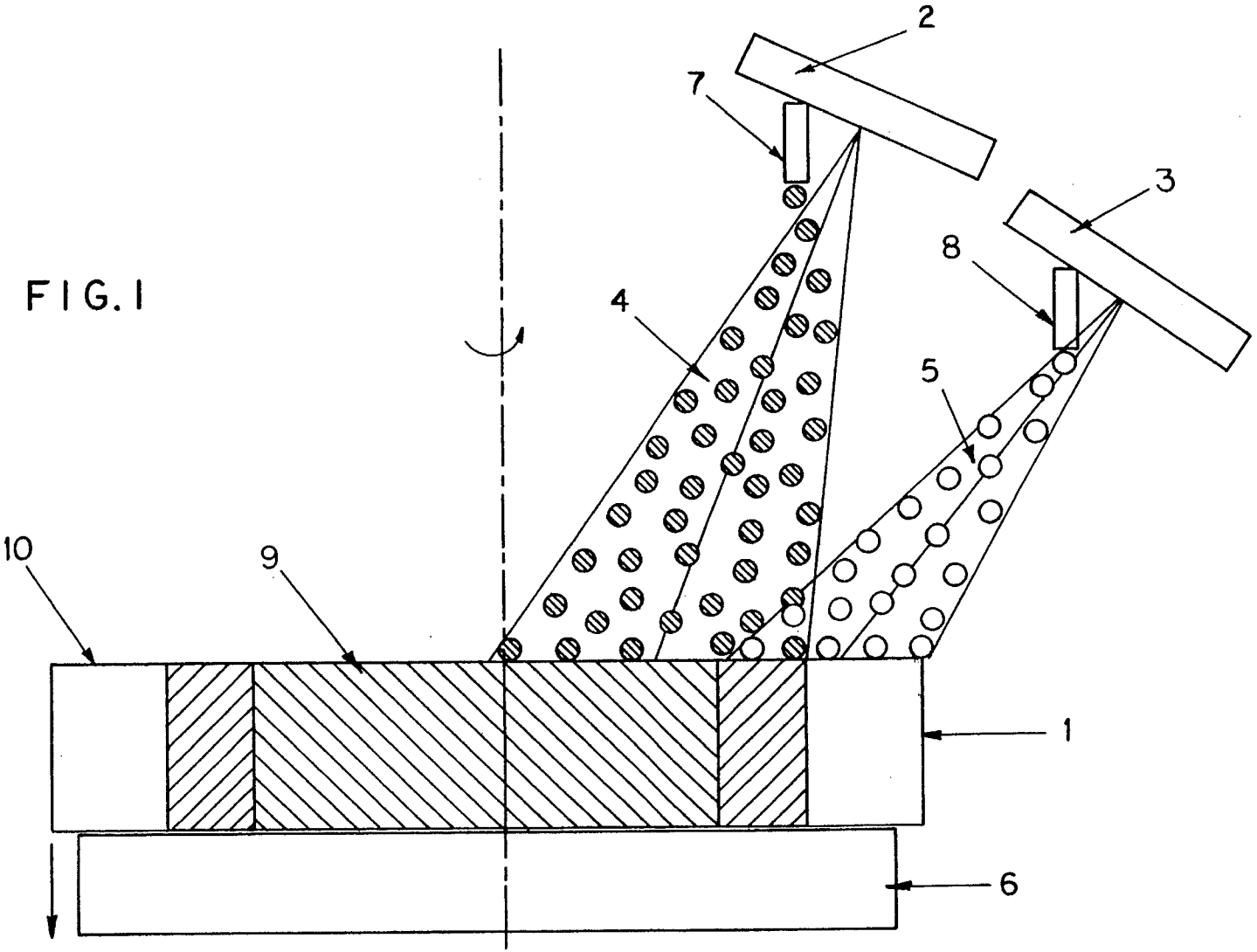
FIG. 1 depicts the production of a cylindrical preform.

FIG. 1 is a diagrammatic elevation of a spray casting apparatus for making a cylindrical preform 1 (round billet). Molten metal (not represented) is fed to two nozzles 2,3 from which emerge two overlapping streams of metal droplets 4,5 directed onto the cross-section of a rotating substrate 6 of round cross-section. The droplet streams 4,5 consolidate on substrate 6 or on the growing, round billet 1 (dischargeable in the direction of the arrow) and form a solid block 1. 7 and 8 are additional nozzles through which particles can be injected into the droplet streams 4,5. Schematic representation of particle density along the radius of the round billet shows that a composite billet 1 develops that consists of core 9 and outer layer 10 with differing properties therein and in a zone between core 9 and layer 10 where the streams 4,5 overlap.

A special advantage of the method described consists in that there is no defined line between core 9 and outer layer 10 and that preform 1 has no separating joint, contrary to older state-of-the-art methods (roller cladding, powder metallurgy). The disadvantages of these methods such as bonding defects, costly quality assurance, etc., are avoided.

EXAMPLE

A 300 mm dia. round billet 1 was produced according to the invention, the core 9 (dia. 220 mm) of which was in copper sprayed from nozzle 3 at 1.200° C. and the outer layer 10 (thickness 40 mm) of which was in copper sprayed from nozzle 2 at 1.200° C. and alumina particles (15μm size) discharged from nozzle 8 to comprise 10 volume % of outer layer 10.

The gas-metal ratio chosen for the atomization was 0.6 (inside) and 0.4 (outside).

The round billet 1 was extruded at 750° C. to a 62 mm dia. round rod. Its outer layer 10 had a thickness of 3 mm and its core 9 a diameter of 56 mm.

Figure 2:
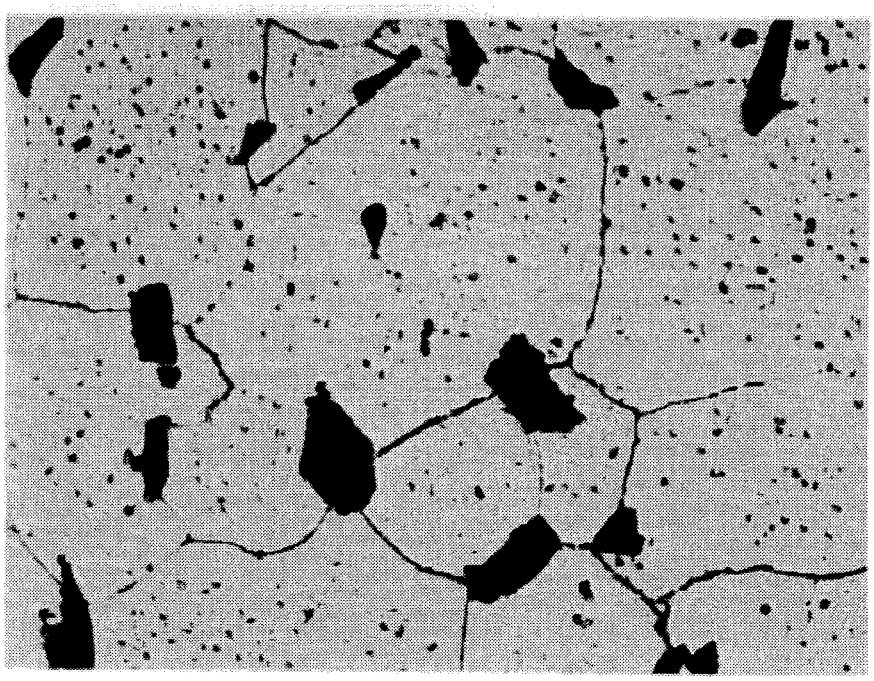
FIG. 2 shows the deposition of modifying additions at the grain boundaries.

FIG. 2 shows a 500X magnification of the deposition of alumina particles at the grain boundaries in a CuCrZr alloy forming the core of a preform using nozzles 2,7.

The embodiments of the invention in which an exclusive property or privilege is claimed are defined as follows:

1. An article of copper or a copper alloy manufactured from a rotationally symmetrical preform, said preform having a metal matrix cross-section consisting of at least a core, an outer layer surrounding the core and an undefined boundary provided between the core and the outer layer, at least one of the core and the outer layer having additives contained therein which result in the core and the outer layer having different properties from each other, said additives comprising metallic particles of molybdenum, niobium, tungsten or lead which are insoluble in the metal matrix.

2. An article according to claim 1, wherein the particles are provided at grain boundaries contained in the metal matrix.

3. An article of copper or a copper alloy manufactured from a rotationally symmetrical preform, said preform having a metal matrix cross-section consisting of at least a core, an outer layer surrounding the core and an undefined boundary provided between the core and the outer layer the core and the outer layer having additives contained therein which result in the core and the outer layer having different properties from each other, said additives comprising metallic particles of molybdenum, niobium, tungsten or lead which are insoluble in the metal matrix.

4. An article according to claim 3, wherein the particles are provided at grain boundaries contained in the metal matrix.

5. A method of manufacturing a rotationally symmetrical preform by atomizing molten metal by means of a gas jet in a nozzle and by deposition of the droplets on a suitable substrate, comprising:

arranging at least two independent nozzles so that their droplet streams overlap and are directed onto a rotating substrate of circular cross-section, and injecting insoluble metal particles into either the first or into the second droplet stream.

6. A method according to claim 5, wherein at least one nozzle simultaneously injects the metal particles that are insoluble and particles that are clearly soluble in the metal matrix into the first and second droplet streams.

7. A method according to claim 5, wherein the insoluble metal particles are particles of molybdenum, niobium, tungsten or lead.

8. A method of manufacturing a rotationally symmetrical preform by atomizing molten metal by means of a gas jet in a nozzle and by deposition of the droplets on a suitable substrate, comprising:

arranging at least two independent nozzles so that their droplet streams overlap and are directed onto a rotating substrate of circular cross-section, and injecting insoluble metal particles into both the first and second droplet streams.

9. A method according to claim 8, wherein at least one nozzle simultaneously injects the metal particles that are insoluble and particles that are clearly soluble in the metal matrix into the first and second droplet streams.

10. An article according to claim 8, wherein the insoluble metal particles are particles of molybdenum, niobium, tungsten or lead.

* * * * *

UNITED STATES PATENT AND TRADEMARK OFFICE

CERTIFICATE OF CORRECTION

PATENT NO. : 5,613,187
DATED : March 18, 1997
INVENTOR(S) : Dieter STOCK et al

It is certified that error appears in the above-indentified patent and that said Letters Patent is hereby corrected as shown below:

Column 3, line 37; after "layer" insert ---,---.

Column 4, line 36; change "An article" to ---A method---.

Signed and Sealed this

Twelfth Day of August, 1997

Bruce Lehman

*Attest:*

BRUCE LEHMAN

*Attesting Officer*

*Commissioner of Patents and Trademarks*